US005592694A

United States Patent [19]

Yewer, Jr.

[11] Patent Number: 5,592,694

[45] Date of Patent: Jan. 14, 1997

[54] WRAP TYPE HAND GLOVE

[76] Inventor: Edward H. Yewer, Jr., 6259 N. Hwy. 83, Hartland, Wis. 53029

[21] Appl. No.: 427,943

[22] Filed: Apr. 26, 1995

Related U.S. Application Data

[63] Continuation of Ser. No. 122,858, Sep. 16, 1993, abandoned.

[51] Int. Cl.[6] ..... A41D 19/00

[52] U.S. Cl. ..... 2/161.1; 2/20; 2/162

[58] Field of Search ..... 2/16, 20, 159, 2/161.1, 162, 160, 161.2, 161.6, 170, 917; 602/21, 64; 473/59, 61, 62

[56] References Cited

U.S. PATENT DOCUMENTS

| | | | |
|---|---|---|---|
| D. 295,897 | 5/1988 | Thimm-Kelly | D24/64 |
| D. 300,948 | 5/1989 | Harris et al. | D24/64 |
| D. 320,872 | 10/1991 | McCrane | D29/20 |
| 1,583,606 | 5/1926 | Roussel | 2/20 |
| 2,322,710 | 6/1943 | Eisendrath | 2/20 |
| 3,238,939 | 3/1966 | Stubbs | 473/62 |
| 3,512,776 | 5/1970 | Thomas, Sr. | 473/62 |
| 3,581,312 | 6/1971 | Nickels | 2/159 |
| 3,598,408 | 8/1971 | Klose | 2/170 |
| 3,606,614 | 9/1971 | Dimitroff | 2/20 |
| 3,704,994 | 12/1972 | Krzewinski et al. | 473/62 |
| 3,728,738 | 4/1973 | Andolino | 473/62 |
| 3,815,908 | 6/1974 | Hashimoto | 2/161.2 |
| 4,198,709 | 4/1980 | Clayton | 473/59 |
| 4,228,548 | 10/1980 | Cohen | 473/62 |
| 4,287,609 | 9/1981 | Amadeo | 2/16 |
| 4,546,495 | 10/1985 | Castillo | 2/161.1 |
| 4,575,075 | 3/1986 | Tarbox et al. | 2/161.1 |
| 4,584,993 | 4/1986 | Nelson | 128/77 |
| 4,747,163 | 5/1988 | Dzierson | 2/161.1 |
| 4,809,366 | 3/1989 | Pratt | 2/162 |
| 4,843,651 | 7/1989 | Gramza et al. | 2/161.1 |
| 4,850,341 | 7/1989 | Fabry et al. | 128/44 |
| 4,854,309 | 8/1989 | Elsey | 128/87 R |
| 4,881,533 | 11/1989 | Teurlings | 128/87 R |
| 4,883,073 | 11/1989 | Aziz | 128/878 |
| 4,899,763 | 2/1990 | Sebastian et al. | 128/878 |
| 4,905,321 | 3/1990 | Walunga | 2/161 A |
| 5,014,689 | 5/1991 | Meunchen et al. | 128/77 |
| 5,033,119 | 7/1991 | Wiggins | 2/161 A |
| 5,058,573 | 10/1991 | Hess et al. | 128/77 |
| 5,058,576 | 10/1991 | Grim et al. | 128/87 |
| 5,214,799 | 6/1993 | Fabry | 2/20 |

OTHER PUBLICATIONS

"Bart's" Catalogue pp. 40 and 41, admitted prior art.

*Primary Examiner*—Michael A. Neas

*Attorney, Agent, or Firm*—Quarles & Brady

[57] ABSTRACT

A sports glove for wrapping around a human user's hand has finger loops for the little and ring fingers and an inverted tear drop shaped thumb hole. In one form, an angled wrist wrap panel is provided, which can be helically wrapped over a wrist tab to resist back bending of the hand. Four fastening patches are provided in the wrist wrap version, with two patches securing a back panel and a little finger side tab and the other two patches securing the wrist wrap. A palm pad is provided which extends from the palm past the crotch between the thumb and forefinger, and two palm pads can be provided.

2 Claims, 9 Drawing Sheets

FIG. 17
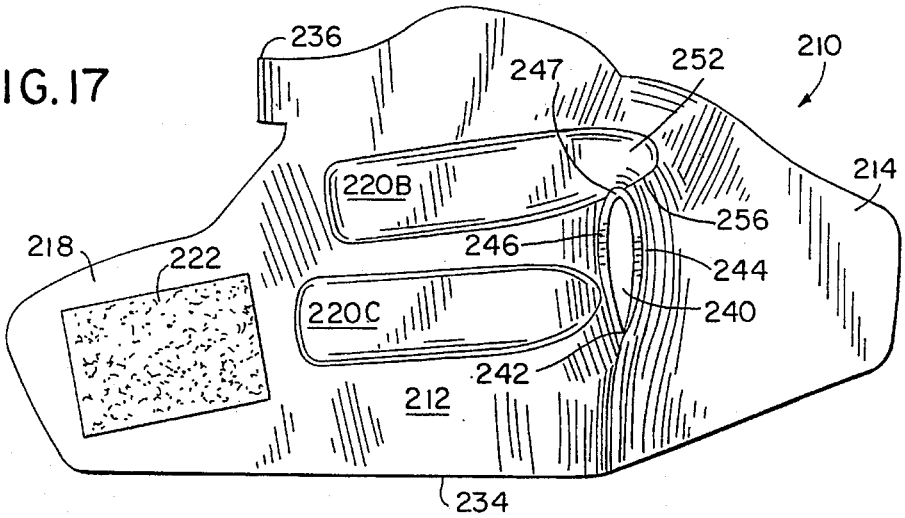
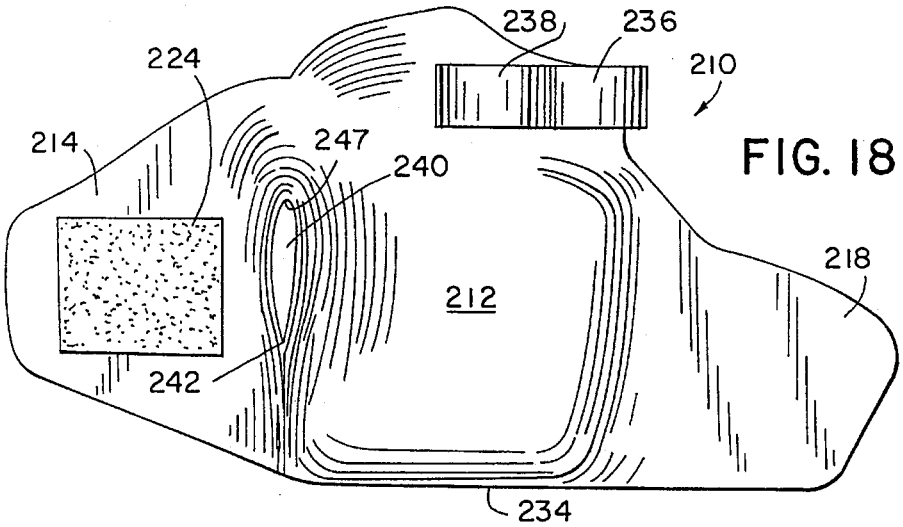
FIG. 18
FIG. 19
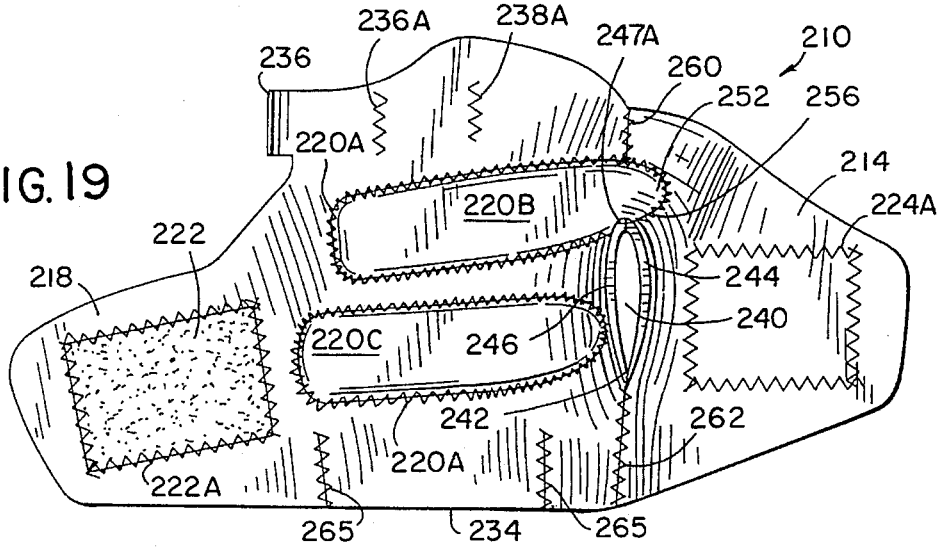

WRAP TYPE HAND GLOVE

This is a continuation of application Ser. No. 08/122,858 filed Sep. 16, 1993, now abandoned.

FIELD OF THE INVENTION

This invention relates to gloves of the type that are used in sporting activities such as bicycle riding, water skiing, weight lifting and other activities.

BACKGROUND OF THE INVENTION

Sports gloves for bicycle riding, water skiing, weight lifting and other similar activities, usually involving gripping a cylindrical bar, are well known. Quite frequently, these types of gloves are made of fabric covered neoprene or neoprene materials in combination with other flexible web materials such as leather or imitation leather. These types of gloves also typically wrap around the hand and are secured with hook and loop type fasteners.

These types of gloves are also usually provided with a finger hole or loop for each of the five fingers of a human hand. The finger holes are usually open so that at least the finger tips are exposed for better sensory perception. In these types of gloves, it has been found that finger movement is sometimes unduly restricted. For example, when riding a bicycle, the thumb, forefinger and middle finger are especially active for performing such functions as gear shifting and braking.

Gloves of the type discussed above unduly limit moving the fingers and therefore contribute to fatigue. These problems are especially acerbated in a user suffering from carpal tunnel syndrome, arthritis, tendonitis, or other hand and wrist ailments. In such users, movement of the thumb, the middle finger and the forefinger can be especially difficult.

In addition, it is advantageous to apply pressure to the hand and wrist so as to maintain the hand in a neutral position, in which the wrist is substantially straight. Prior art gloves have provided wrap around straps or splints to maintain the wrist straight. However, the known prior art left room for improvement for the ease of securing the glove around a human user's wrist and the stability of support given to the wrist by the glove.

SUMMARY OF THE INVENTION

The invention provides a sports glove which is easy to put on, and provides stable wrist support without unduly restricting finger movement. The glove is of the type made from a flexible web material and having a palm panel for covering the palm of a human hand, a back panel fixed to the palm panel for covering a portion of the back of a human hand and means for securing the glove around a human hand. Only two finger loops are fixed to the palm panel, one of the loops being positioned to encircle the little finger of a human hand and the other of the loops being positioned to encircle the ring finger of the human hand. Thus, movement of the middle and forefinger is unhampered, while providing ample support to the palm panel of the glove.

In another aspect, a glove of the invention has a thumb hole therethrough of an elongated inverted teardrop shape with an apex of the teardrop shape pointing toward a wrist edge of the glove, the apex being located below a proximal joint of a human user's thumb on the back side of the thumb. Edges of the glove defining the hole extend away from the apex and diverge therefrom toward opposite sides of the human user's thumb. Past the opposite sides of the thumb where the edges pass, the edges converge away from the apex and meet at a location on the palm side of the thumb at a level which is between the proximal joint at the base of the thumb and the distal joint of the thumb. Thereby, back bending of the thumb is unhampered. Preferably, the edges meet at a point adjacent to the distal joint of the thumb on the palm side of the thumb, so that the palm side of the thumb between the proximal joint and the meeting point is covered by the glove for protection, and cushioning if the glove is made of neoprene or other cushioning material.

Regarding this aspect, the thumb hole is preferably defined between an edge of a palm panel of the glove and an edge of a back panel of the glove, the palm panel and back panel being separate panels which are sewn together along edges which are continuous with the edges which define the thumb hole. Thereby, a thumb hole of the desired shape can be conveniently made.

In an especially useful feature, a palm pad which is secured to the palm panel extends over a seam between the palm panel and the back panel, the seam extending along the crotch between a user's thumb and forefinger. This provides additional protection and cushioning for the crotch between the thumb and forefinger and also protects the seam between the palm panel and back panel. Preferably, the palm pad extends from one edge adjacent the apex of the crotch between the thumb and forefinger toward the forefinger to cushion this area without unduly restricting thumb movement. Also, two separate palm pads can be provided and spaced apart so as to reduce bunching of the palm material of the glove when a cylindrical bar is grasped. Two separate palm pads also helps ventilation through the glove in the palm area.

In another aspect, the wrist wrap panel extends from the back panel at an angle, the angle being of a magnitude and direction to wind the wrist wrap panel helically around a user's wrist in the direction toward the user's elbow as the wrist wrap panel is wound around the wrist in a relaxed state. The wrist wrap panel can thereby be wrapped around the wrist without exerting undue force on the hand which tend to bend it back and without interfering unduly with the base of the hand.

In an especially preferred aspect, a wrist tab extends from the palm panel toward a user's elbow, the wrist tab being adapted to be wrapped over by the wrist wrap panel and be located between the wrist wrap panel and the user's skin when the glove is worn by a user. The securing of the wrist wrap panel in this position helps resist bending back of the hand, and therefore helps maintain the wrist in a neutral, straight position.

In another especially preferred aspect, a tab is secured to the palm panel along a side of the palm panel opposite from the back panel, the tab being foldable over the back of a human hand to underlie a portion of the back panel. A first fastening patch is secured to an outer surface of the tab and a second fastening patch is secured to an inner surface of the back panel to engage the first fastening patch in releasable facing contact. A third fastening patch is secured to an outer surface of the wrist wrap panel and a fourth fastening patch is secured to the wrist wrap panel adjacent to a free end thereof. The third and fourth patches are engagable in releasable facing contact when the wrist wrap panel is wrapped around a user's wrist. Thereby, the glove is secured around the wrist with two circumferentially spaced apart fastening points, which helps maintain the relative positioning of the various layers of the glove in the wrapped state, which thereby helps to stiffen the glove so as to help maintain the wrist in a neutral position.

BRIEF DESCRIPTION OF THE DRAWINGS

FIG. 17 is a front elevation view thereof in an unwrapped position, said view of a matching left hand glove of my invention being a mirror image of FIG. 17;

FIG. 18 is a rear elevation view thereof in an unwrapped position, said view of a matching left hand glove of my invention being a mirror image of FIG. 18;

FIG. 19 is a front elevation view of another embodiment of a glove of my invention shown in an unwrapped position, said glove being the same as the glove shown in FIGS. 11–18 except that FIG. 19 also illustrates seams and stitching;

DETAILED DESCRIPTION OF THE PREFERRED EMBODIMENT

Figure 1:
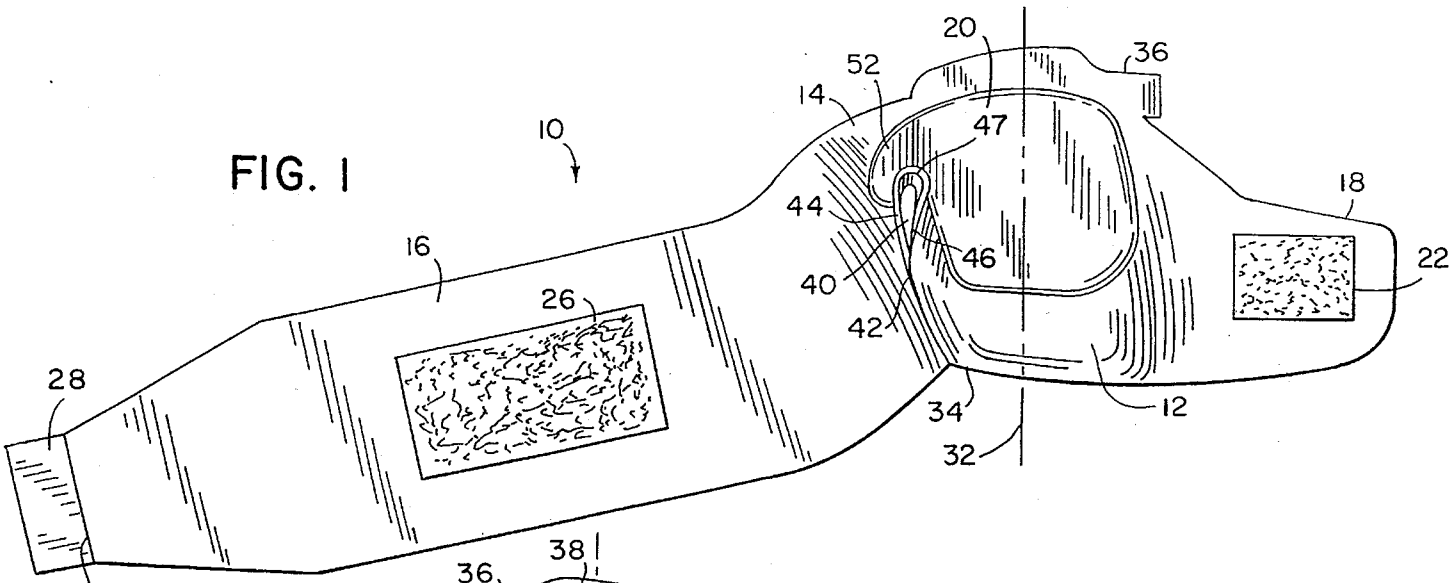
FIG. 1 is a front elevation view of a left hand glove of my invention in an unwrapped position, said view of a matching right hand glove of my invention being a mirror image of FIG. 1.
Figure 2:
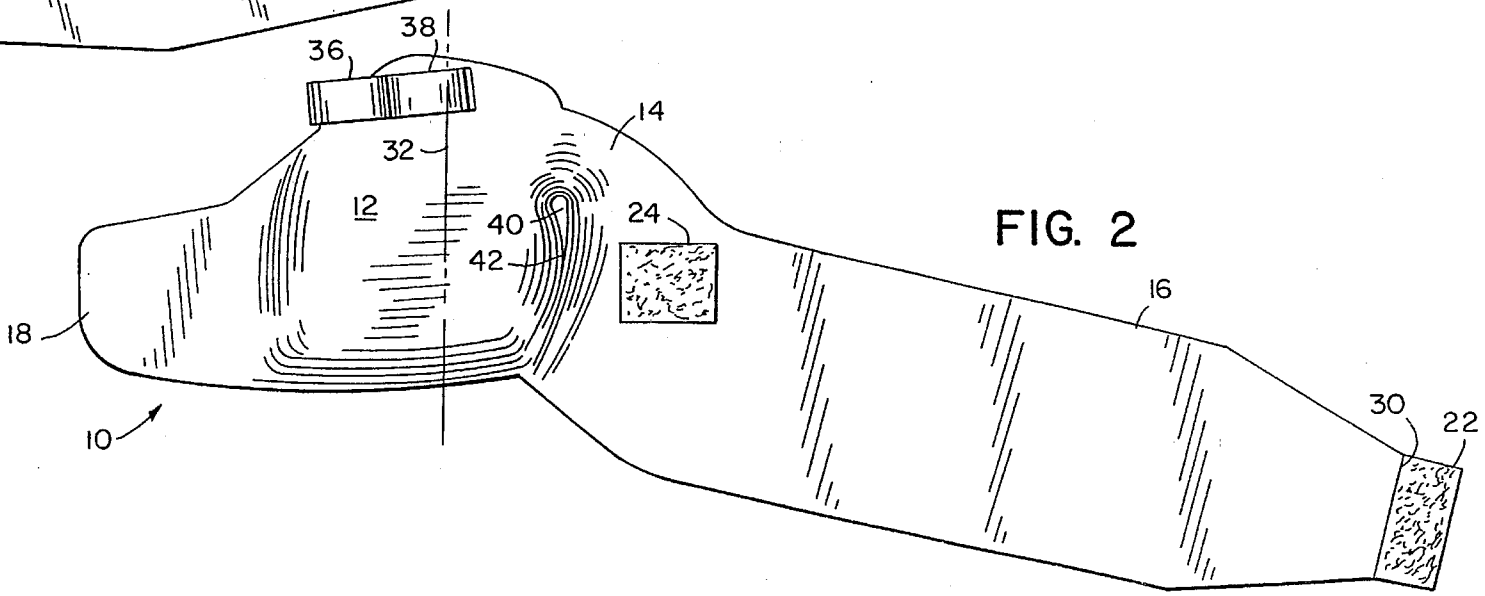
FIG. 2 is a rear elevation view thereof in an unwrapped position, said view of a matching right hand glove of my invention being a mirror image of FIG. 2.
Figure 3:
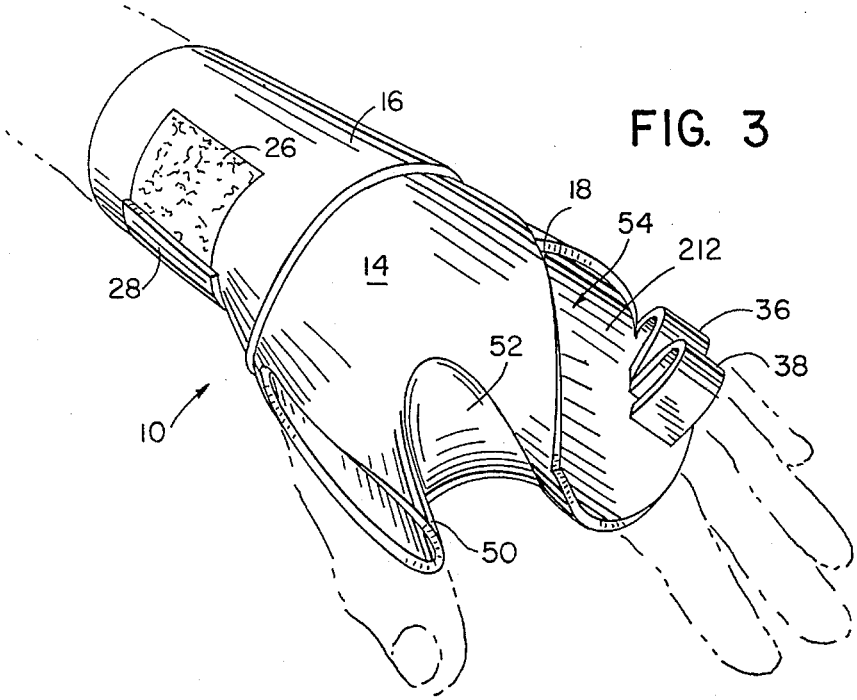
FIG. 3 is a right side top front perspective view thereof in a wrapped position, the left side top front perspective view of a matching right hand glove of my invention being a mirror image of FIG. 3.
Figure 4:
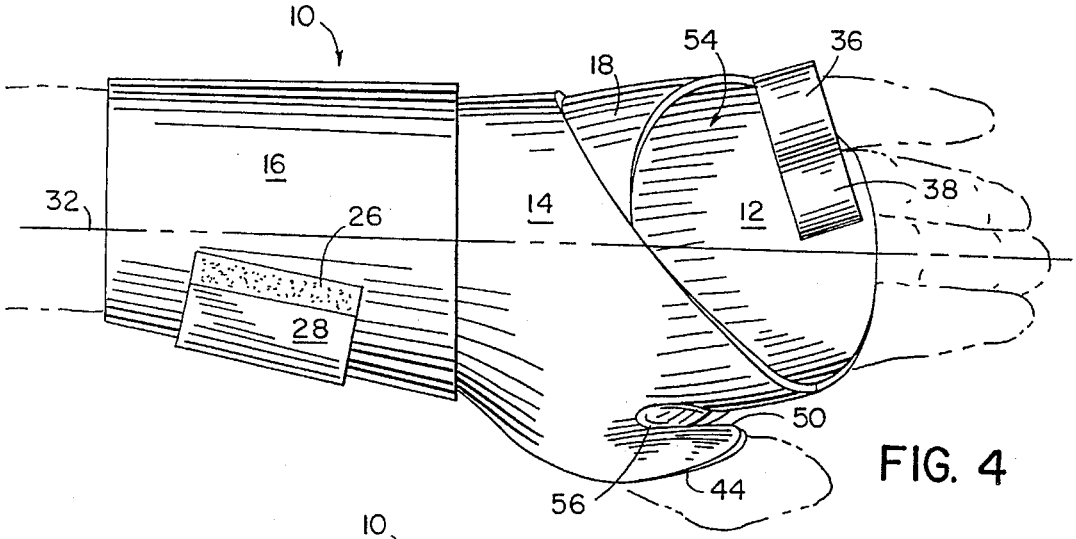
FIG. 4 is a top (or back side) plan view thereof in said wrapped position, said view of a matching right hand glove of my invention being a mirror image of FIG. 4.
Figure 5:
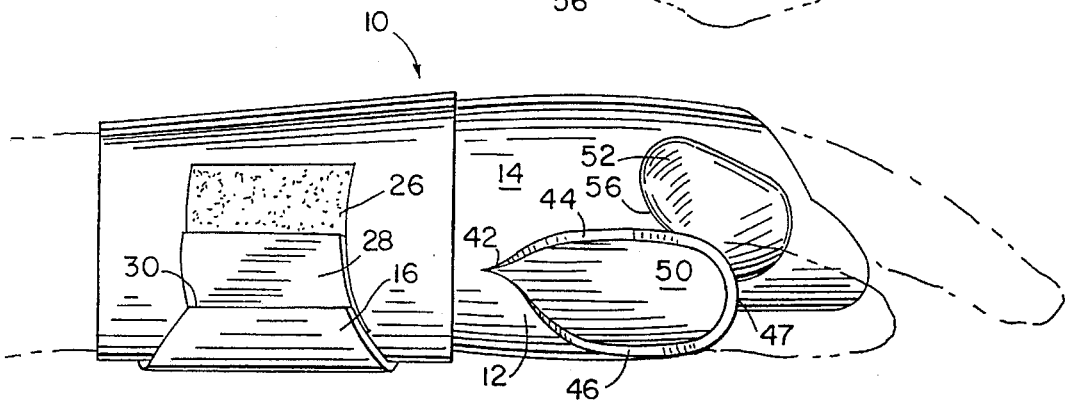
FIG. 5 is a right side elevation view thereof in said wrapped position, a left side elevation view of a matching right hand glove of my invention being a mirror image of FIG. 5.
Figure 6:
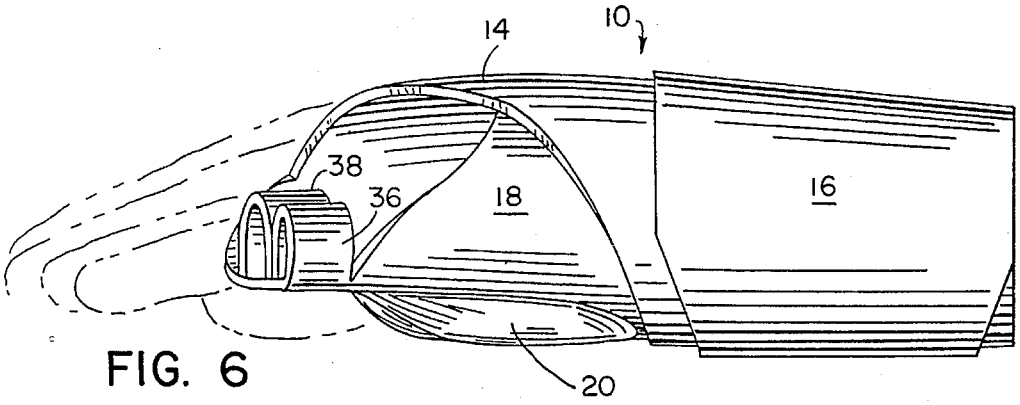
FIG. 6 is a left side elevation view thereof in said wrapped position, a right side elevation view of a matching right hand glove of my invention being a mirror image of FIG. 6.
Figure 7:
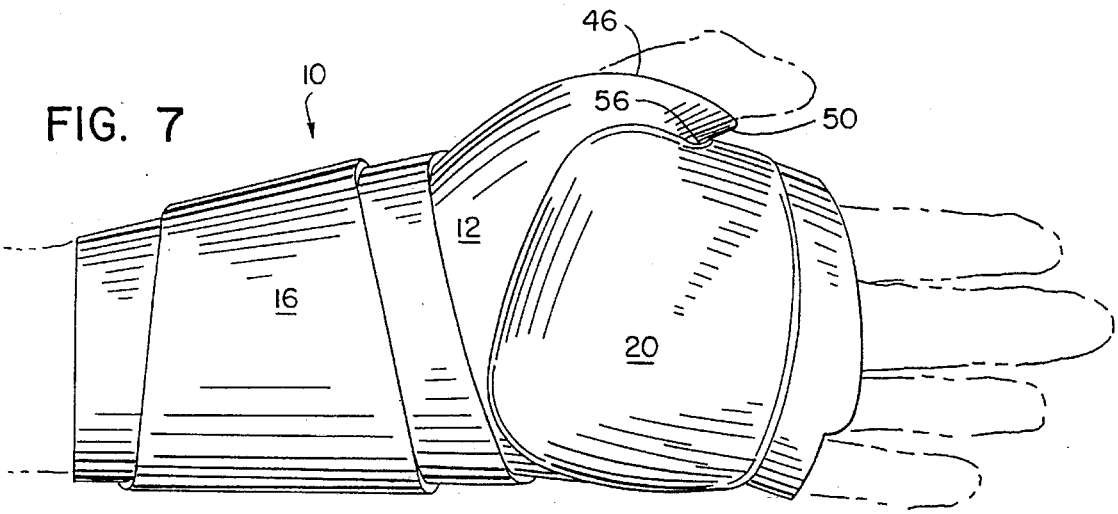
FIG. 7 is a bottom (or palm side) plan view thereof in said wrapped position, said view of a matching right hand glove of my invention being a mirror image of FIG. 7.
Figure 8:
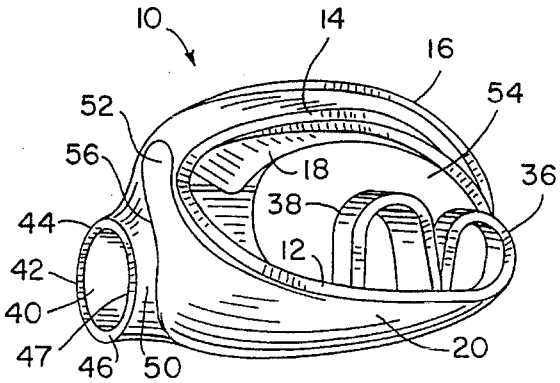
FIG. 8 is a front elevation view thereof in said wrapped position, said view of a matching right hand glove of my invention being a mirror image of FIG. 8.
Figure 9A:
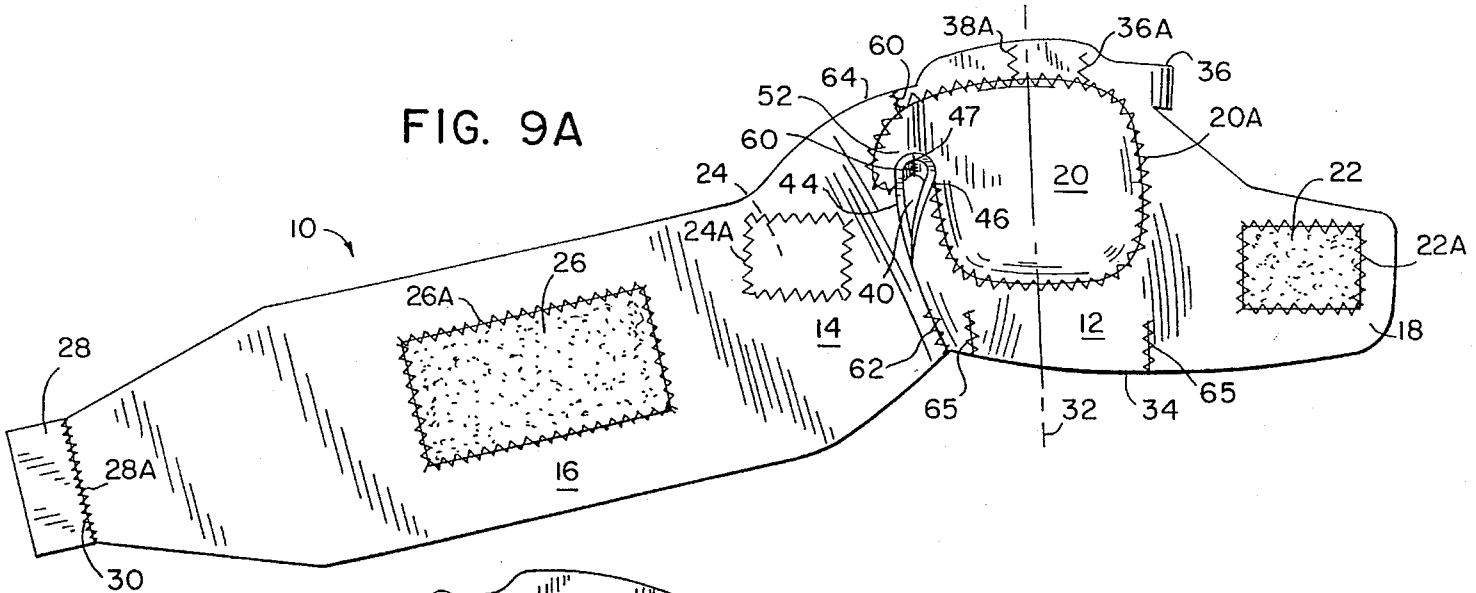
FIG. 9A is a front elevation view of a glove showing my invention in an unwrapped position, said glove being the same as the glove shown in FIGS. 1–8 except that FIG. 9 also illustrates seams and stitching.

Referring to FIGS. 1–9A, a glove 10 of the invention has a palm panel 12, a back panel 14 secured to the thumb side of the palm panel 12, a wrist wrap panel 16 extending from the side of the back panel 14 which is opposite from the palm panel 12, and a tab 18 extending from the side of the palm panel 12 which is opposite from the back panel 14. A palm pad 20 is secured on the outer surface of the palm panel 12, such as by stitching as shown in FIG. 9A. A first fastening patch 22 is secured to the outer side of tab 18, such as by stitching shown in FIG. 9A, and a second fastening patch 24 is secured to the inner surface of back panel 14, such as by stitching 24A shown in FIG. 9A. The patches 22 and 24 are preferably hook and loop type patches which mate in releasable engagement in well known fashion.

A third fastening patch 26 is secured on the outer surface of wrist wrap panel 16, such as by stitching 26A as shown in FIG. 9A, and a fourth fastening panel 28 is secured to free end 30 of wrist wrap panel 16, such as by stitching 28A as shown in FIG. 9A. The panels 26 and 28 are also preferably mating male and female Velcro™ panels which may be engaged in well known releasable fashion.

The glove 10 has an axis 32 which is generally aligned with the middle finger metacarpal bone of a human user's hand when the glove is on the hand. Wrist wrap panel 16 extends from back panel 14 at an angle of approximately 100 to 110 degrees from the axis 32 so that as the wrist wrap panel 16 is wrapped around the wrist of a user, it winds helically about the wrist in a direction toward the user's elbow in a relaxed state of the panel 16, i.e. even when the panel 16 is not being stretched. This helps the wrist wrap panel wrap around the wrist, without it interfering with the base of the hand. However, it should be understood that the invention is not limited to an angle of 100 to 110 degrees, but could be practiced using any angle which enables the wrist wrap panel 16 to wind helically about the wrist in the relaxed state. Preferably, the wrist wrap panel 16 is long enough to wrap for at least one full revolution around the wrist under comfortable tension, and in the embodiment 10, is long enough to wrap approximately 1½ revolutions under comfortable tension (approximately 1 revolution when relaxed), from the back panel 14 to the free end 30.

Only two finger loops 36 and 38 are provided in the glove 10. The loops 36 and 38 are formed by a strap extension of the palm panel 12 which is looped over the external surface of the palm panel 12 and secured at spaced locations by stitches 36A and 38A as shown in FIG. 9A. The finger loop 36 is for encircling the little finger and the loop 38 is for encircling the ring finger. No loops are provided for the middle finger or forefinger. While two loops 36 and 38 are preferred, aspects of the present invention could be practiced with any number of finger holes, including with only one of the finger loops 36 or 38 or with neither of the finger loops 36 or 38. Where the loops 36 and 38 are provided as in the glove 10, however, it is preferred that those loops be positioned so as to encircle their respective fingers between the proximal and middle joints of those fingers.

A thumb hole 40 is also provided in the glove 10 between the palm panel 12 and the back panel 14. The thumb hole 40 is of an elongated teardrop shape which is inverted when the glove is placed in a position such that the hand is directed upward. The thumb hole 40 extends from an apex 42, which points toward the wrist and is located below the proximal joint of the thumb of a user wearing the glove. From the apex, the edges 44 and 46 which define the thumb hole 40 diverge toward opposite sides of the user's thumb and from those sides the edges 44 and 46 converge to meet on the palm side of the user's thumb at a location 47 which is between the proximal joint and the distal joint of the thumb. In the preferred embodiment, the edges 44 and 46 meet on the palm side of the thumb at approximately the level of the distal joint of the thumb. This provides an area 50 of material adjacent to the palm side of the thumb which helps cushion and protect the thumb when a bar or other object is grasped in the crotch between the thumb and forefinger.

In this regard, it is also preferred to provide an extension 52 of the palm pad 20 which extends into the crotch of the glove 10 between the thumb hole 40 and the large hole 54 of the glove 10 through which the fingers extend. Preferably, the extension 52 does not cover the area 50, but extends from an edge 56 (FIGS. 4, 5, 7 and 8) which is at the apex of the crotch between the thumb and forefinger and from there toward the forefinger. This provides for gripping and additional cushioning in the area of the forefinger side of the crotch between the thumb and forefinger, which is often a pressure point when grasping a handle bar or other object and is also often used in conjunction with a thumb to pinch or grasp an object.

Preferably, the palm panel 12, back panel 14, wrist wrap panel 16 and tab 18 are made of fabric covered neoprene, typically approximately 3 mm thick. Such material is well known and is desirable for its highly elastic properties and also because it provides cushioning. The fabric coverings for the neoprene may be any suitable fabric, preferably also elastic, such as nylon or Lycra™. Terry cloth may also be used, for example on an area of the back panel or wrist wrap panel which would cover the back of the hand, to be used for wiping sweat off a brow or other body part. In the preferred embodiment, terry cloth is used on the front and rear surfaces of the back panel 14 and wrist wrap panel 16, and on the rear surface of the palm panel 12 and tab 18. This is desirable for wicking moisture away from the hand. On the front surfaces of the palm panel 12 and tab 18, nylon is used. Neoprene suitable for making the glove 10 is available from Rubatex Corporation of Bedford, Va. under the commercial designation R-1400-N. It is preferred that the neoprene have small holes (e.g., holes randomly distributed over a total of 10–20% of the area) for venting. However, it should be understood that aspects of the invention are not limited to making a glove of the invention from neoprene materials, and that other flexible web materials could be used including other types of closed cell and open cell foam materials as well as non-foam sheet materials and elastic and inelastic fabric materials.

The palm pad 20 is preferably also made of neoprene, and is not fabric covered so that it provides a frictional gripping surface. It is preferably made with a smooth textured skin or with any suitable pattern to enhance gripping. Neoprene suitable for the palm pad 20 is available from Rubatex Corporation of Bedford, Va. under the commercial designation R-1400-N, TexSkin.

Preferably, the palm panel 12 and tab 18 are provided in one integral piece, and the back panel 14 and wrist wrap panel 16 are provided in a second integral piece. The two pieces can be sewn together along their thumb side edges as shown by the stitching 60 and 62 in FIG. 9A. The stitching 60 extends from the top edge 64 underneath the extension 52 and to the thumb hole 40 where the edges 44 and 46 that define the thumb hole 40 meet at 47. The stitching 62 extends from the apex 42 of the thumb hole 40 to the wrist edge 34 of the glove. Stitching 65 closes notches at the base of the palm panel 12 which are helpful to conform the wrist edge 34 to the shape of a wrist.

The first and second fastening patches 22 and 24 are preferably approximately the same size so that in normal use they would be placed in general registration and fastened to one another. However, the third fastening panel is substantially longer than the fourth fastening panel 28. This is so that the user can vary the tension exerted on his hand and wrist after the wrist wrap panel 16 is wrapped around the wrist by adjusting the position on the third fastening panel 26 where the fourth fastening panel 28 is attached to the third fastening panel 26.

Figures 9B, 9C, 9D:
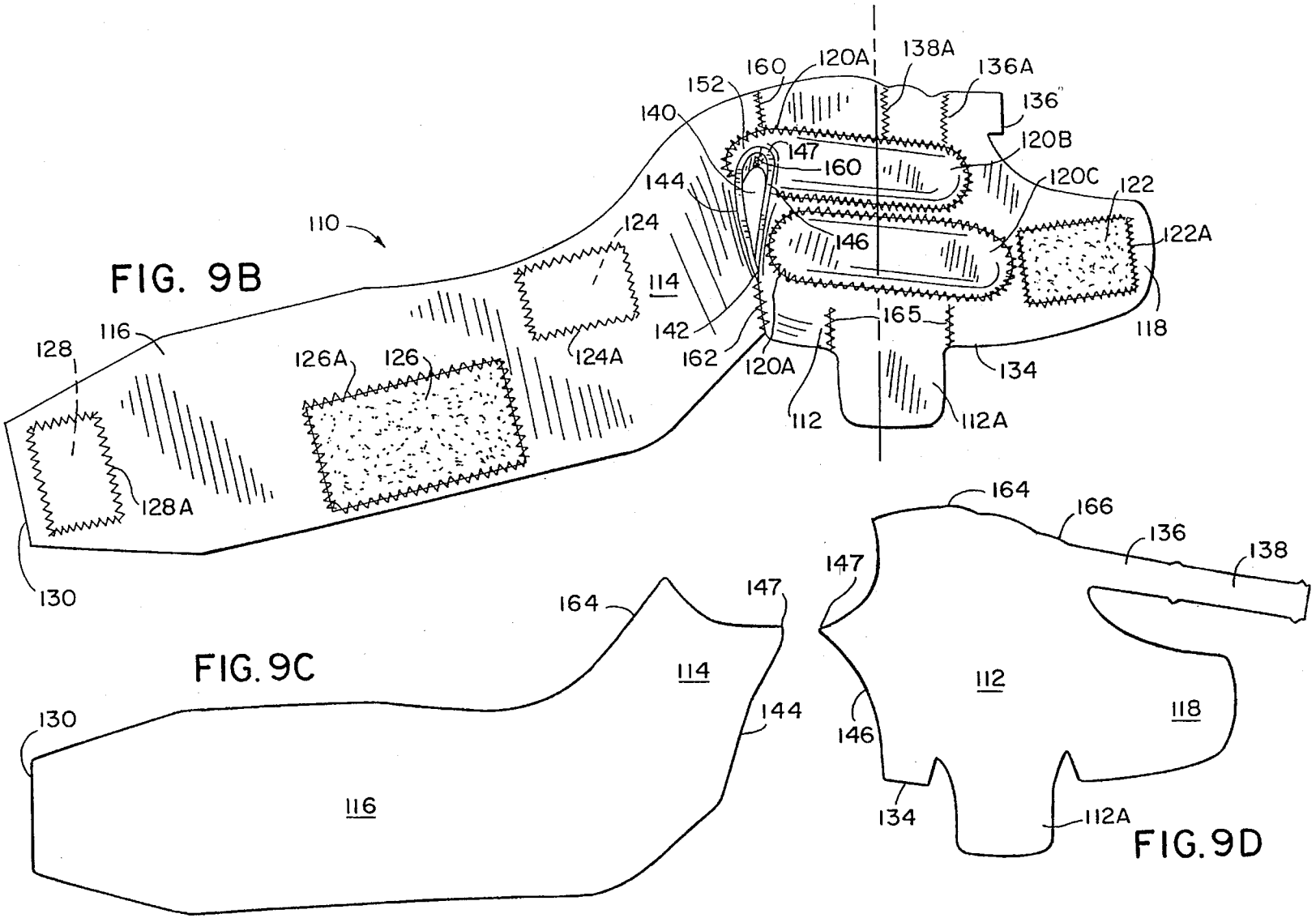
FIG. 9B is a front elevation view of a another embodiment of a glove of my invention, said view of a matching right hand glove of my invention being a mirror image of FIG. 9B.
FIG. 9C is a front elevation view of a pattern for making a portion of the glove of FIG. 9B.
FIG. 9D is a front elevation view of a pattern for making another portion of the glove of FIG. 9B.
Figure 11:
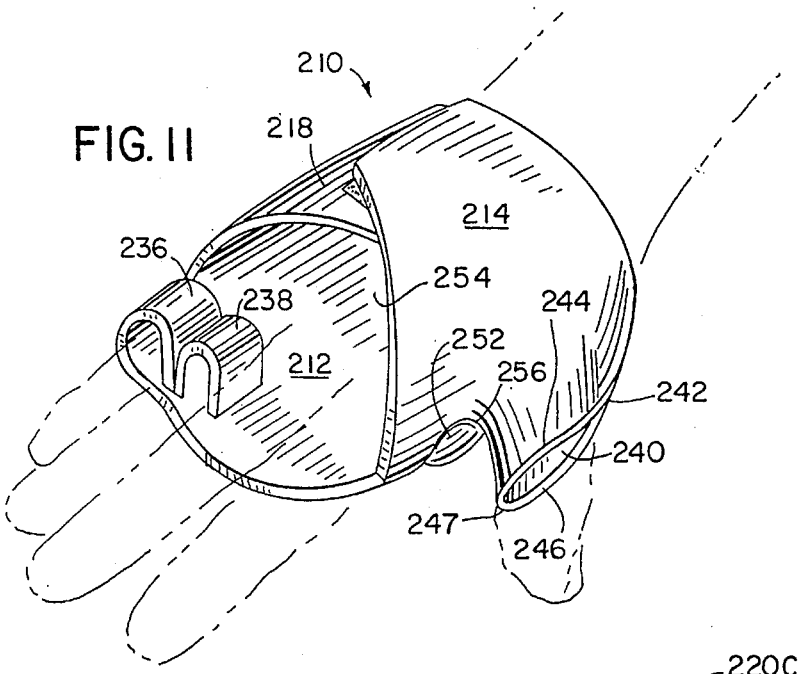
FIG. 11 is a right side top front perspective view of a another embodiment of a glove of my invention in a wrapped position, the left side top front perspective view of a matching left hand glove of my invention being a mirror image of FIG. 11.
Figure 12:
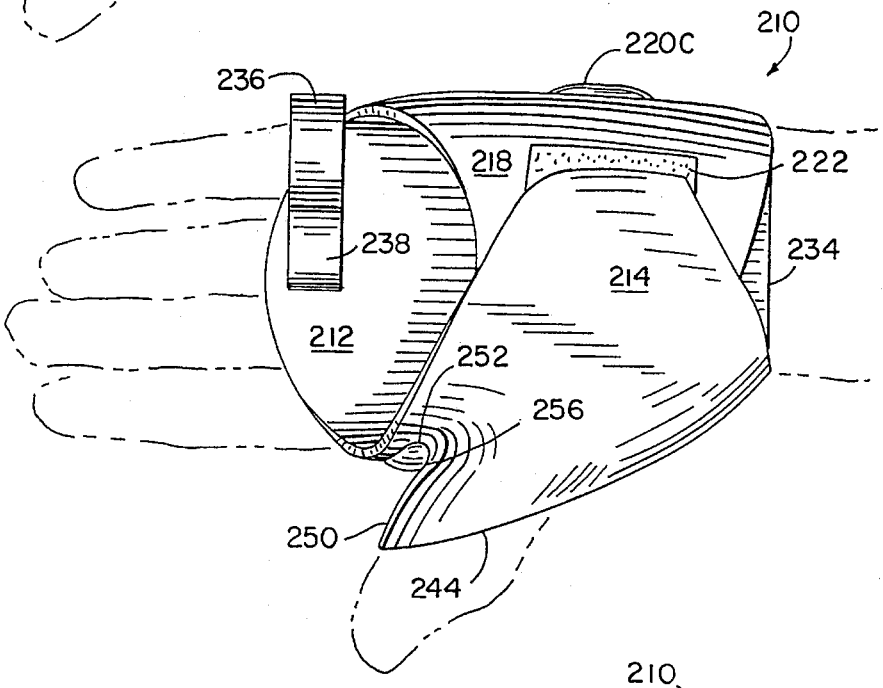
FIG. 12 is a top (or back side) plan view thereof in said wrapped position, said view of a matching left hand glove of my invention being a mirror image of FIG. 12.
Figure 13:
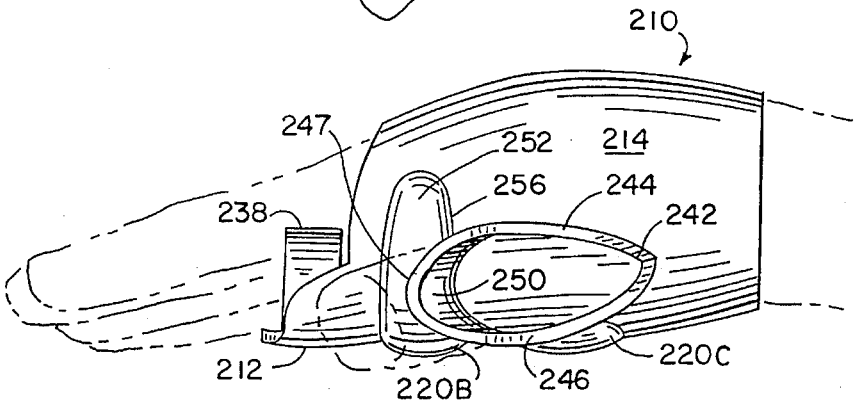
FIG. 13 is a left side elevation view thereof in said wrapped position, the right side elevation view of a matching left hand glove of my invention being a mirror image of FIG. 13.
Figure 14:
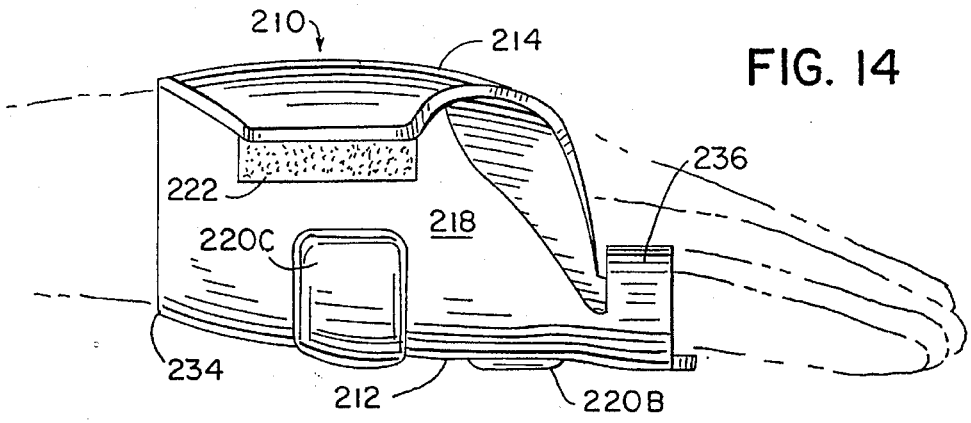
FIG. 14 is a right side elevation view thereof in said wrapped position, the left side elevation view of a matching left hand glove of my invention being a mirror image of FIG. 14.
Figure 15:
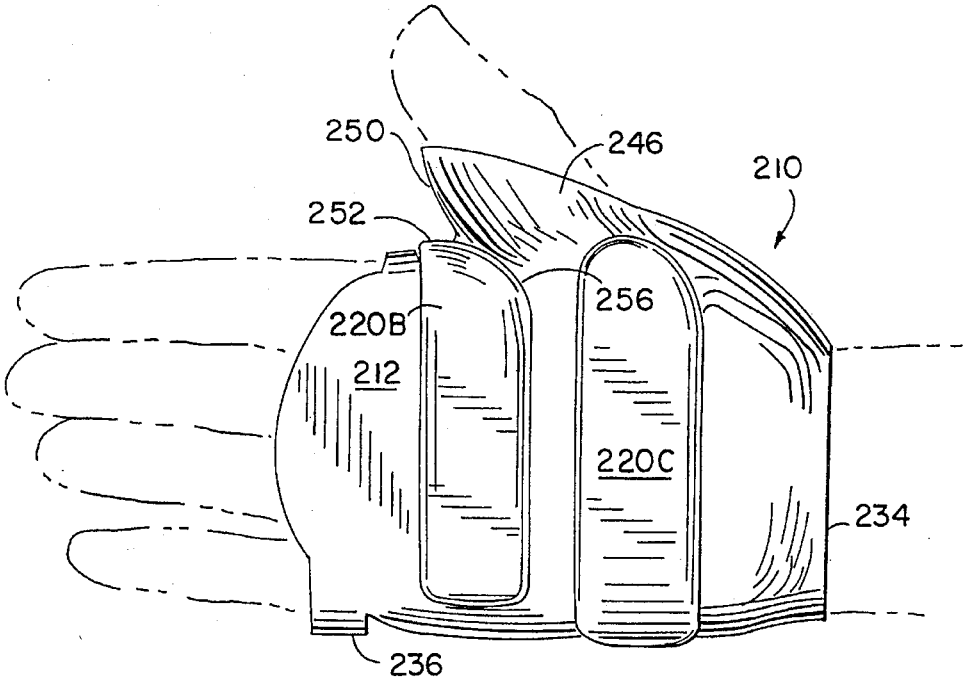
FIG. 15 is a bottom (or palm side) plan view thereof in said wrapped position, said view of a matching left hand glove of my invention being a mirror image of FIG. 15.
Figure 16:
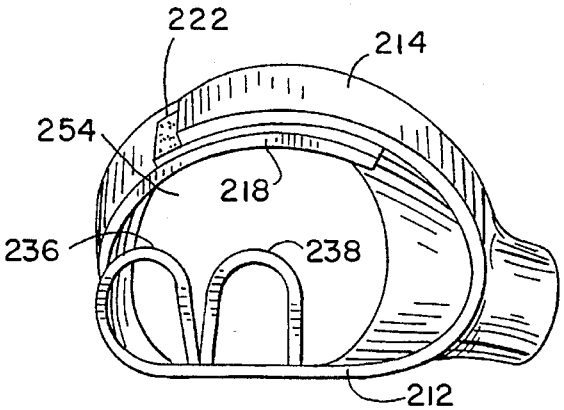
FIG. 16 is a front elevation view thereof in said wrapped position, said view of a matching left hand glove of my invention being a mirror image of FIG. 16.

Another embodiment 110 of the invention is illustrated in FIG. 9B. Elements of the glove 110 corresponding to elements of the glove 10 are identified by the same reference number, plus 100.

The glove 110 is substantially the same as the glove 10, except for providing the palm pad in two pieces 120B and 120C, and providing a wrist tab 112A as an extension of palm panel 112 and sewing fourth fastening patch 128 to wrist wrap panel 116 on all four sides. Providing the palm pad in two pieces helps avoid bunching of the palm material when a cylindrical bar is grasped by a user. The wrist tab 112A is wrapped over by the wrap panel 116, so that it resides between the user's skin and the inner (or rear) surface of the panel 116 when the glove is worn by a user. This helps resist bending back of the hand and therefore helps to maintain the wrist in a neutral (straight) position.

The glove 110 is preferably made using the patterns shown in FIGS. 9C and 9D. The pattern 166 is used for cutting the piece that includes the palm panel 112 and tab 118 and the pattern 168 is used for cutting the piece which includes the back panel 114 and wrist wrap panel 116.

Figure 10:
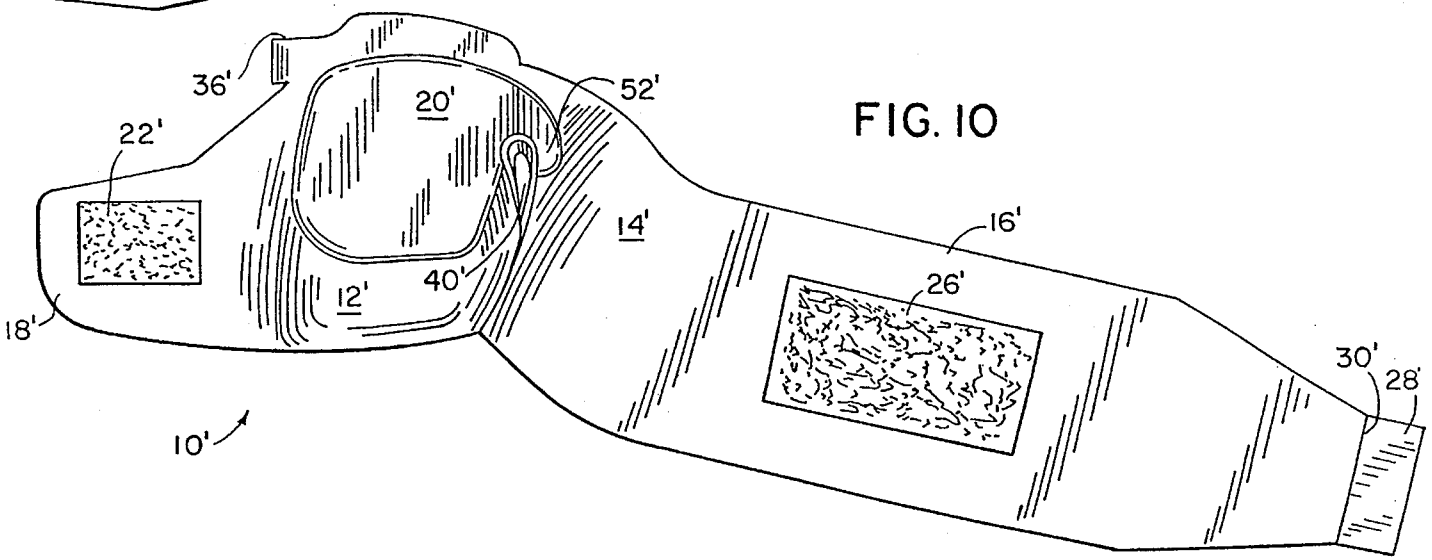
FIG. 10 is a front elevation view of a right hand glove of my invention shown in an unwrapped position and which matches the left hand glove shown in FIGS. 1–8, FIG. 10 being a mirror image of FIG. 1.

FIG. 10 illustrates a glove 10' which is a matching right hand glove to the glove 10. Glove 10' is the same in all respects to the glove 10 except that it is for the right hand. The invention may be applied to both left and right hand gloves, and such gloves would typically be supplied in matching left and right hand pairs.

FIGS. 11–18 and 19, which illustrates the same glove as that shown in FIGS. 11–18 but with stitching, discloses a glove 210 which is the same in all respects as the glove 10 except that no wrist wrap panel 16 is provided (and not the third 26 or fourth 28 fastening patches which are secured to the wrist wrap panel 16) and two palm pads 220B and 220C are provided instead of a single palm pad 20. In the glove 200, elements corresponding to the elements of the glove 10 are given the same reference numbers plus 200. The glove 200 may be desirable in applications where stiffening of the wrist is not desired.

Figure 20A:
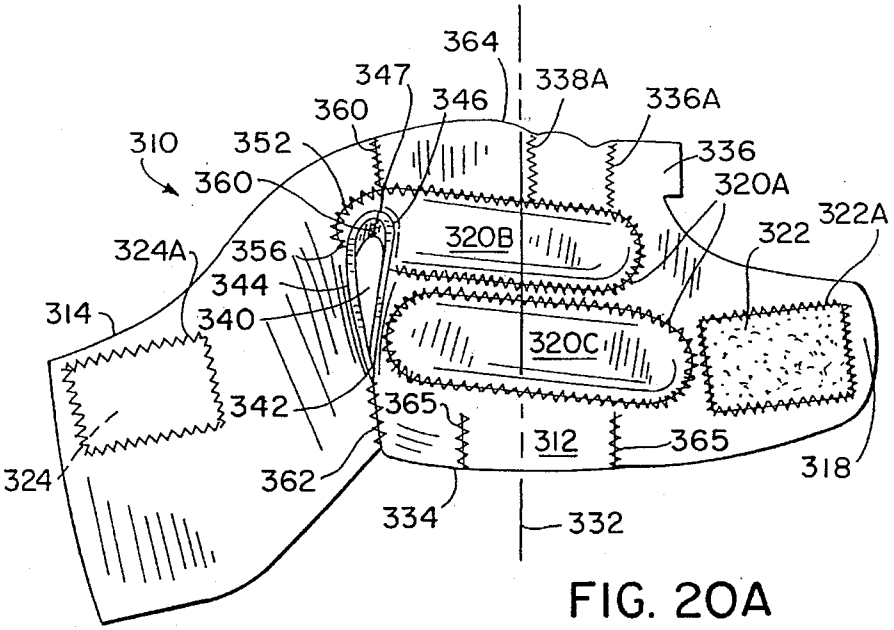
FIG. 20A is a front elevation view of another embodiment of a glove of my invention in an unwrapped position, said view of a matching right hand glove being a mirror image of FIG. 20A.
Figure 20C:
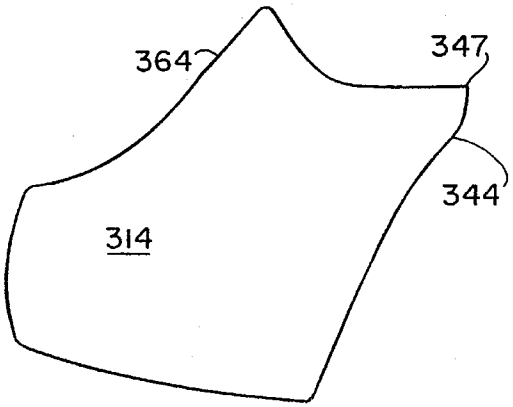
FIG. 20C is a front elevation view of a pattern for making another portion of the glove of FIG. 20A.
Figure 20D:
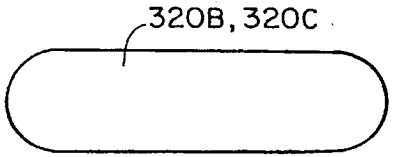
FIG. 20D is a front elevation view of a pattern for making another portion of the glove of FIG. 20D.

Another embodiment 310 of the invention is illustrated in FIG. 20A. Elements of the glove 310 corresponding to elements of the glove 10 are identified by the same reference number, plus 300.

Figure 20B:
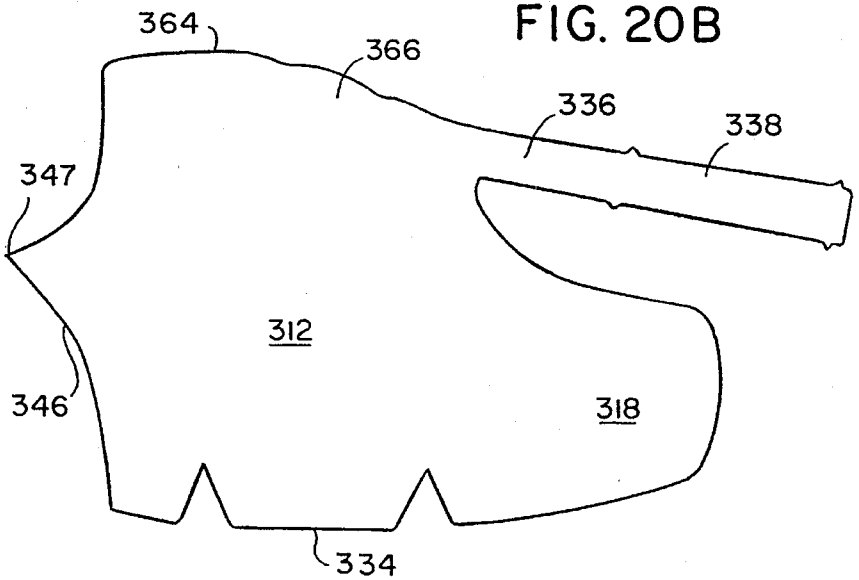
FIG. 20B is a front elevation view of a pattern for making a portion of the glove of FIG. 20A.

The glove 310 is substantially the same as the glove 210, except for minor variations in shape. The glove 310 is preferably made using the patterns shown in FIGS. 20B, C and D. The pattern 366 is used for cutting the piece that includes the palm panel 312 and tab 318 and the pattern 368 is used for cutting the piece which includes the back panel 314. Pattern 370 is used for the palm pads 320B and 320C.

Preferred embodiments of the invention have been described in considerable detail. Numerous modifications and variations will be apparent to those of ordinary skill in the art. Therefore, the invention should not be limited to the embodiments described but should be defined by the claims which follow.

I claim:

1. A sports glove of the type made from a flexible web material and having a palm panel for covering the palm of a human hand, a back panel fixed to said palm panel for covering a portion of the back of a human hand, and a wrist wrap panel extending from a side of said back panel opposite from said palm panel, the improvement wherein:

said palm panel covers said palm from one side to the other and from wrist to fingers;

a tab is secured to said palm panel along a side of said palm panel opposite from said back panel, said tab being foldable over the back of a human hand to underlie a portion of said back panel;

a first fastening patch is secured to an outer surface of said tab;

a second fastening patch is secured to an inner surface of said back panel to engage said first fastening patch in releasable facing contact;

a third fastening patch is secured to an outer surface of said wrist wrap panel;

a fourth fastening patch is secured to said wrist wrap panel adjacent to a free end thereof, said third and fourth patches being engagable in releasable facing contact when said wrist wrap panel is wrapped around a user's wrist;

a closed thumb hole is defined between said palm panel and said back panel; and said flexible web material is elastic.

2. The improvement of claim 1, further comprising a wrist tab extending from said palm panel toward a user's elbow, said wrist tab being adapted to be wrapped over by said wrist wrap panel and be located between said wrist wrap panel and said user's skin when said glove is worn by a user.

* * * * *